US005842879A

United States Patent [19]

Walsh et al.

[11] Patent Number: 5,842,879

[45] **Date of Patent: *Dec. 1, 1998**

[54] ELECTRICAL SWITCH CONNECTORS

[75] Inventors: Michael Walsh, Patchogue; Miroslaw Blaszczec, Lindenhurst, both of N.Y.

[73] Assignee: Coin Bill Validator, Inc., Hauppauge, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 762,305

[22] Filed: Dec. 9, 1996

Related U.S. Application Data

[63] Continuation of Ser. No. 260,061, Jun. 15, 1994.

[51] Int. Cl.[6] ..... H01R 13/28

[52] U.S. Cl. ..... 439/289

[58] Field of Search ..... 439/74, 289, 293, 439/295, 862

[56] References Cited

U.S. PATENT DOCUMENTS

| | | | |
|---|---|---|---|
| 3,193,793 | 7/1965 | Plunkett et al. | 434/295 |
| 3,934,959 | 1/1976 | Gilissen | 439/77 |
| 4,045,107 | 8/1977 | Sutherland | 439/289 |
| 5,055,054 | 10/1991 | Doutrich | 439/66 |
| 5,234,353 | 8/1993 | Scholz et al. | 439/289 |
| 5,385,490 | 1/1995 | Denoter et al. | 439/289 |

*Primary Examiner*—Neil Abrams
*Assistant Examiner*—Barry M. L. Standig
*Attorney, Agent, or Firm*—Bauer & Schaffer

[57] ABSTRACT

A pair of terminals is provided, each terminal being identical to the other and being formed of an insulating body having a plurality of electrical conductive contacts partially embedded therein. The frontal sections of the contacts are exposed from the surface of the body so that the terminals may be placed into frontal abutment with the conductive contacts in mutual engagement.

4 Claims, 2 Drawing Sheets

ELECTRICAL SWITCH CONNECTORS

This is a Continuation of Ser. No. 08/260,061, filed Jun. 15, 1994.

BACKGROUND OF THE INVENTION

The present invention relates to an improved electrical connector system and in particular to a system in which the connector terminals move into abutment in a face-to-face arrangement.

Electrical connectors are conventionally formed of male terminals (plugs) and female terminals (sockets) so that the plugs are inserted either coaxially or at some small angle into respective sockets. Generally, the plugs and sockets have circular cross sections and engage coaxially, but frequently, the plugs are formed as thick bladelike elements adapted to slide sideways into resilient springlike sockets. The prior art is replete with a number of other variations of conventional plug and socket arrangements all based upon the insertion of one terminal into the other.

In designing modern machine equipment as well as electronic components the use of conventional plug and sockets have a number of disadvantages. First, the throw or movement of the conventional plug relative to the socket requires considerable space and the direction of movement must also be axial with respect to the socket. Still another disadvantage lies in the fact that both plug and socket are subjected to wear and damage on repeated insertion and removal. This is a particular problem when dealing with miniaturized contact systems used in modern electronic devices. Additionally, the component parts are generally complex, difficult to fabricate and costly to use.

It is therefore the object of the present invention to provide a contact system which overcomes and avoids the foregoing disadvantage.

SUMMARY OF THE INVENTION

According to the present invention, a connector system is provided in which the terminals are constructed so as to contact and abut in face-to-face arrangement, and to be movable broadside relative to each other.

Preferably, the terminals are identically formed and comprise striplike flat surfaced contacts. Since the terminals are identical, they are neither male nor female and do not require insertion one within the other. The throw or movement can thus be small and the direction of movement selected for best results in a given environment.

Full details of the present invention are set forth in the following description and illustrated in the accompanying drawing.

RELATED DISCLOSURE

The present electrical switch connector employs certain details found in U.S. Pat. Nos. 4,884,671 and 5,259,490 issued to Ivo Gardellini, to which reference to such details and the disclosure of said patents are to be made as if more fully set forth herein.

The present invention is used also with the inventions disclosed in U.S. patent applications Ser. No. 08/260,120, entitled PAPER CURRENCY VALIDATOR (Attorney's Docket No. P-2824-6) and U.S. Pat. No. 5,527,031 entitled MECHANISM FOR INSURING ALIGNMENT OF CURRENCY IN CURRENCY VALIDATORS (Attorney's Docket No. P-2824-8), filed simultaneously herewith, by the same inventors. The disclosures of these applications are incorporated herein as if more fully set forth.

DESCRIPTION OF THE PREFERRED EMBODIMENTS

The present invention is very suitable for use in machines or equipment where two electrically connected machine parts or processing units are physically connected and where one of the parts must be frequently removed and replaced. An illustrative example of the present invention and one which would make its structure and function quite clear is in a currency changer normally attached to change makers, vending machines or casino slot machines.

In each of these machines, the dollar bill received is processed and stored in a container holding a large number of such bills which container must be periodically removed, intact, so as not to jeopardize the security of the money collected. It will be appreciated that such machines are small and space limited and that the need for frequent removal and replacement by unskilled personnel of the money container creates great difficulty when conventional plugs and sockets are employed in the interconnections.

Figure 1:
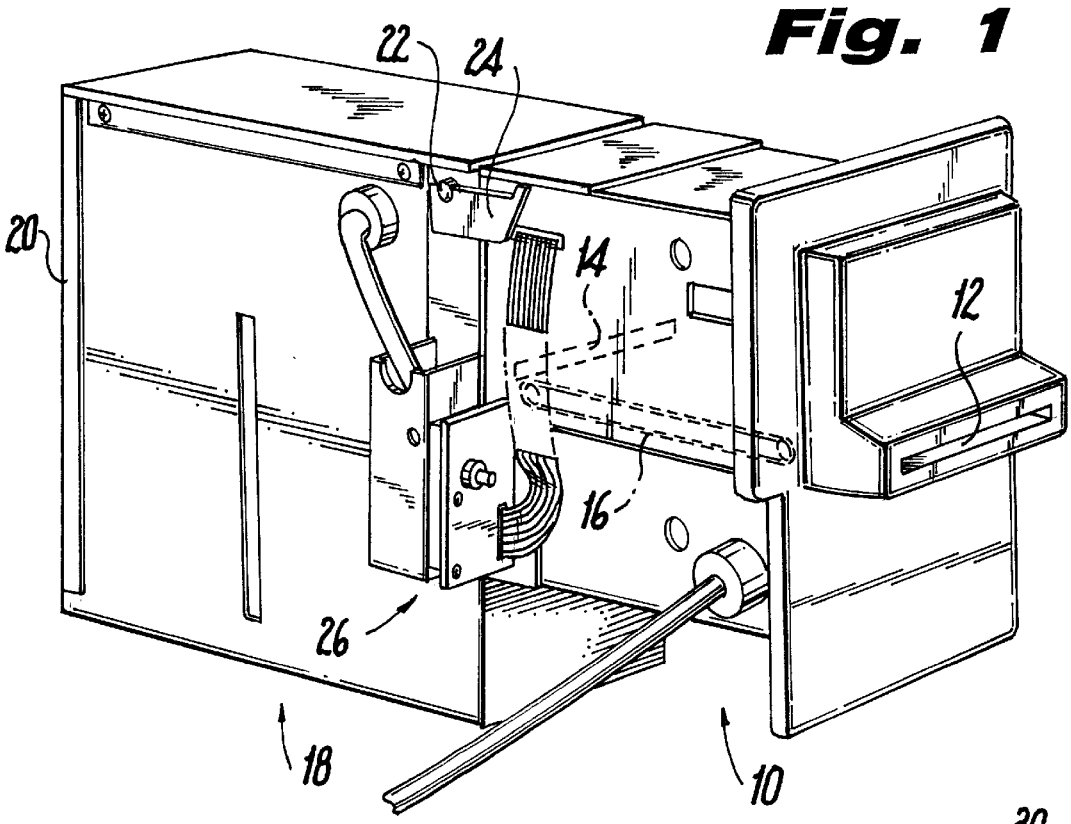
FIG. 1 is a perspective view of the operative structure of a dollar bill changer illustrating the application of the present invention there.

A representative arrangement of a dollar bill changer is seen in FIG. 1. The apparatus comprises an acceptor housing, generally depicted by the numeral 10, having a slot inlet 12 for introduction of the currency and a slot outlet 14 between which are located mechanisms for sensing, verifying, and counting the input, and a conveyor 16 for moving the currency from inlet to outlet. Mounted on the exterior of the acceptor housing 12 on the outlet side is a money stacker container 18 in which the currency is received and stored. The storage container is integrally formed, being sealed on all sides, but provided with a flat door 20 at its rear which is locked and sealed. It also is provided with an inlet slot which aligns with the outlet 14 in the acceptor when the two are properly located.

In some instances, the money container is slidable axially into and out of contact with the acceptor housing riding on side rails and in other instances it is hung by pins 22 on a pair of hooks 24 at fixed the upper corner of the acceptor 10.

The storage container 18 and the acceptor housing 10 are electrically interconnected by a pair of male and female terminals, generally depicted by the numeral 26, for ultimate connection to the computer control system not only to determine the validity and value of the currency but also to insure integrity of the system and prevent unwarranted separation and removal of the storage container. On the other hand, the storage container 18 must be periodically removed and replaced with an empty container. Thus, it will be seen that very little space will exist within a small dollar bill changing machine for the use of a standard plug and socket electrical connector, even if miniaturized. Further, the placement of the electrical connector is awkward and cumbersome being placed on the exterior of the acceptor housing 10 and container 18. Even if it were to be placed on the rear face of the acceptor housing and the front face of the storage container, there would be considerable difficulty since repeated tilting or sliding of the container into and out of connection with the acceptor housing, particularly by inexperienced operators would soon cause the standard plugs to wear and breakdown.

The present invention provides an electrical connector in which the conventional plug and socket arrangement does not exist and where the mating terminals meet in abutting relationship so that even when tilted there is no sliding contact and the problems discussed above are obviated.

Figure 2:
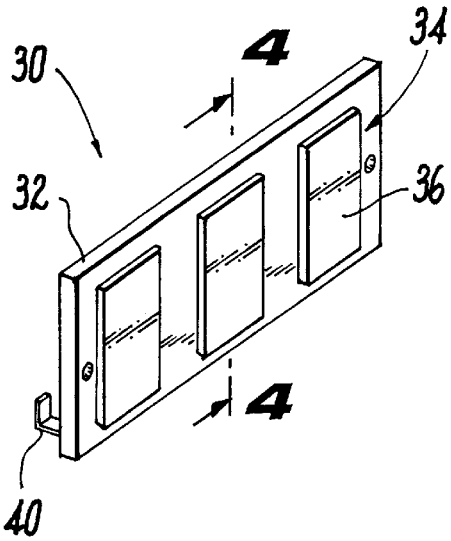
FIG. 2 is a perspective view of a terminal assembly formed in accordance with the present invention.
Figure 3:
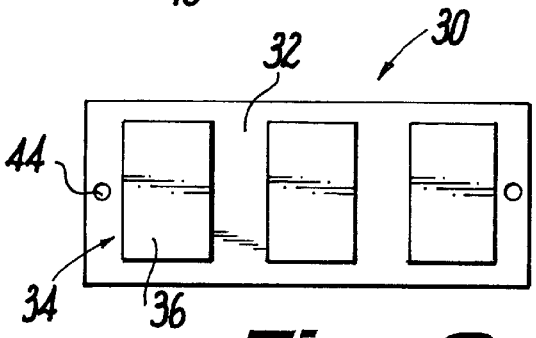
FIG. 3 is a plan view of the terminal strip shown in FIG. 2.
Figure 4:
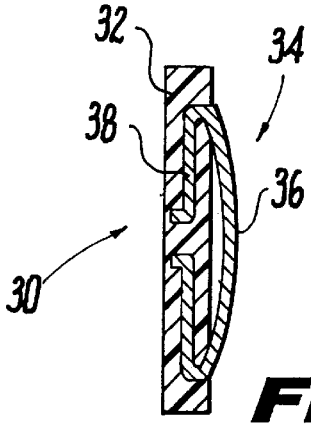
FIG. 4 is a sectional view taken along line 4—4 in FIG. 2.
Figure 5:
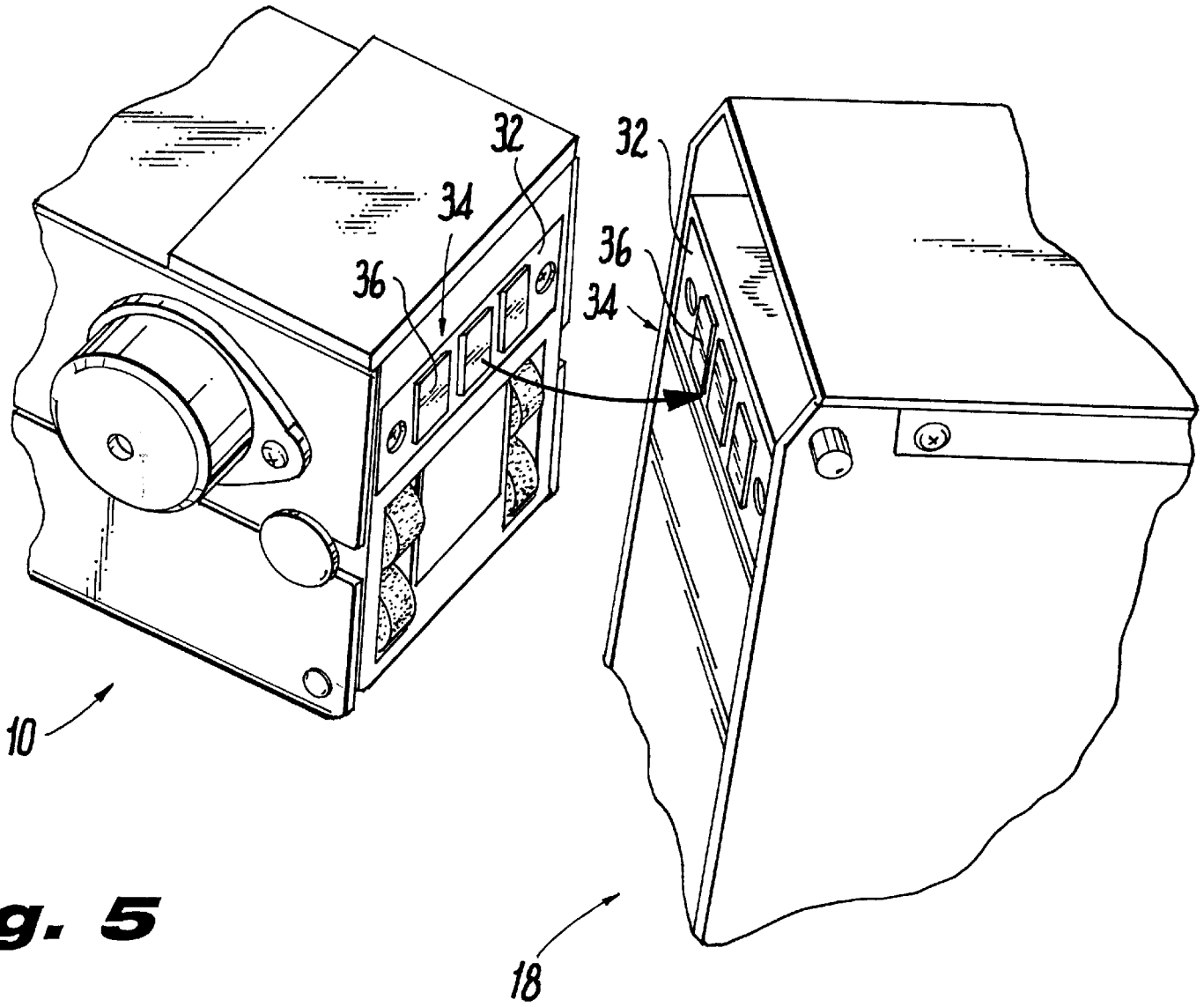
FIG. 5 is an expanded perspective view showing the application to the electrical connection of two sections of a dollar bill changer.

Turning now to FIGS. 2–4, each of the connector terminals of the present invention, be they denoted male or female, generally depicted by the numeral 30, are similar in construction and are, therefore, described at the same time. The terminal 30 comprises a strip 32 of insulating material (such as is commonly used, for example, in the formation of PC boards) in which is embedded a plurality of fingerlike contacts 34. The faces 36 of each of the contacts 34 are exposed above the surface of the strip 32. A while the embedded portion 38 passes substantially from the top to the bottom of the strip, it terminates in postlike extension 40 passing out the rear of the strip 32 to which electrical leads 42 are attached by solder, crimp, connecting sleeves or other conventional means.

The faces 36 of fingerlike contacts 34 are preferably smooth and planar being raised slightly above the surface plane of the strip 32. If desired the contacts may be slightly bowed, convexedly, so as to provide a springlike face. A hairpin bellows, FIG. 4, formed is suitable in this latter instance since the rear portion of the hairpin may be fixedly embedded while the front portion can be left free to act like a spring member. The fingerlike contacts may be made of any suitably conductive material. For small miniature terminals, phosphor bronze or Beryllium copper may be used.

The PC board or strip material may be any thermoplastic resin such as a glass filled thermoplastic or polyphenylene sulfide. The strip can be of any width and height and can be made as thin as 0.05 mm. The strip is provided at each of its ends with a mounting hole 44, although the manner by which it is attached to the machine part can be made in any manner.

Both parts of the entire connector, i.e., the male and female parts are identically constructed thereby simplifying manufacture. Preferably, each terminal is symmetrical from each end and the finger contacts uniformly spaced from each other, that is, whatever direction they are installed, the parts will mate.

The size of the strip 32 and the number of the contacts 34 may be chosen as desired or to fit the given application. Spacing between adjacent contacts 32 are preferably uniform, as would be the size of the contacts themselves. Of course, various systems comprising male and female members may be made, each system having uniform contacts.

It will be seen from the foregoing that a terminal system is thus formed which allows contact to be installed and optimum electrical contact made in tight and narrow places. The male and female members can be easily belted or placed linearly into contact. Plug and socket construction is avoided.

Various changes and modifications have been suggested herein and others will be obvious to those skilled in this art. Therefore, the present disclosure is to be taken as illustrative only and not limiting of the invention.

What is claimed is:

1. An electrical connector assembly comprising a pair of substantially identically constructed terminals, each capable of acting in male or female denominated position, each terminal comprising a body of non-conductive material having opposed first and second sides, said first side having a planar surface, a plurality of similarly constructed electrically conductive blades being arrayed in uniform spatial arrangement on said planar surface, each blade comprising a metallic strip having first and second portions, said first portion of said blade being partially embedded in said body and extending outward of said second side of said body for connection to an electrical lead, said second portion of said blade having a length and width and extending from the planar surface of said body defining a resilient planar frontal face substantially parallel to the planar surface of said body providing a surface contact area, and means for connecting said pair of terminals in face to face abutment so that said blades in one terminal touch without pressure the blades in the opposing terminal and said opposing in surface contact areas have a displacement tolerance equal to at least said predetermined length and width.

2. The electrical connector according to claim 1, wherein a plurality of similarly constructed ones of said conductive blade members are uniformly spaced about said body.

3. The electrical connector according to claim 2, wherein said body is rectilinear having a pair of planar opposed surfaces and the planar frontal faces of said conductive blade members are disposed in parallel with said faces.

4. The electrical connector according to claim 2, wherein said body is rectilinear having a pair of planar opposed surfaces and the planar frontal faces of said conductive blade members are bowed out of the plane of said faces.

* * * * *